United States Patent [19]

Parsell

[11] Patent Number: 4,739,763

[45] Date of Patent: Apr. 26, 1988

[54] SOLAR HEATED SAUNA

[76] Inventor: Ivan L. Parsell, 420 E. Sandusky, Wharton, Ohio 43359

[21] Appl. No.: 895,422

[22] Filed: Aug. 11, 1986

[51] Int. Cl.[4] ..... A61H 33/06

[52] U.S. Cl. ..... 128/372; 128/371; 128/373; 135/93

[58] Field of Search ..... 128/371, 372, 373; 135/91, 93, 102; 47/17

[56] References Cited

U.S. PATENT DOCUMENTS

| | | | |
|---|---|---|---|
| 1,780,363 | 11/1930 | Proctor | 128/372 |
| 1,883,764 | 10/1932 | Collins | 128/372 |
| 1,946,567 | 2/1934 | Braunworth | 128/372 |
| 1,964,463 | 6/1934 | Gittings | 128/372 |
| 2,080,644 | 5/1937 | Weidman | 128/372 |
| 2,653,612 | 9/1953 | Hool | 128/372 |
| 2,659,905 | 11/1953 | Rochford | 135/102 |
| 3,244,186 | 4/1966 | Thomason et al. | 135/92 |
| 3,498,587 | 3/1970 | Friedberg | 128/372 |
| 3,800,468 | 4/1974 | de Graff | 135/102 |
| 4,265,300 | 5/1981 | Kurimoto | 47/17 |
| 4,320,744 | 3/1982 | Fodor et al. | 128/372 |
| 4,387,533 | 6/1983 | Green et al. | 47/17 |

FOREIGN PATENT DOCUMENTS

| | | | |
|---|---|---|---|
| 871492 | 5/1971 | Canada | 128/372 |
| 844639 | 7/1952 | Fed. Rep. of Germany | 128/373 |
| 32082 | 9/1927 | France | 128/372 |
| 1490749 | 8/1967 | France | 135/102 |
| 610743 | 5/1979 | Switzerland | 135/93 |

*Primary Examiner*—Carl D. Friedman
*Assistant Examiner*—Michael Safavi
*Attorney, Agent, or Firm*—Gilden & Israel

[57] ABSTRACT

A solar heated sauna comprises a semicircular section of transparent or smoked rigid plastic which is positionable over a lounge chair, beach blanket, or the like. A user reclines under the sauna on the chair or blanket, and ventilation holes, as well as pivotally connected flaps, are provided for adjusting the amount of ventilation. The design of the invention further includes side positioned holes which can be utilized as handles.

1 Claim, 1 Drawing Sheet

SOLAR HEATED SAUNA

BACKGROUND OF THE INVENTION

1. Field of the Invention

The present invention relates to solar heated structures, and more particularly pertains to a solar heated sauna formed from a rigid smoked or transparent plastic and having adjustable ventilation means.

2. Description of the Prior Art

Solar heated shelters are well known in the prior art. Further, the use of such shelters to achieve a sauna effect while sunbathing is also known. For example, U.S. Pat. No. 2,659,905, which issued to M. Rochford on Nov. 24, 1953, discloses a sunbath tent that effectively comprises a mattress having removable sections of screening positioned thereover. The screening is for the purpose of keeping bugs away from a sunbather and by its design, it would inherently provide a heat intensifying effect. However, the majority of the heat would radiate upwardly through the screen so that a true sauna effect would not be achieved.

In U.S. Pat. No. 3,244,186, which issued to T. Thomason et al on Apr. 5, 1966, a solar heated tent is disclosed which includes transparent or translucent sides exposed to the sun. In the preferred embodiment, this tent is constructed from flexible plastic on some sides, while opposed sides are formed from rigid opaque materials, and no adjustable means are provided whereby the user can control the temperature therein.

A more recent solar heated portable structure is to be found in U.S. Pat. No. 4,320,744, which issued to E. Fodor et al on Mar. 23, 1982. The structure shown in this patent comprises a flexible bottom panel, a flexible side assembly and a flexible transmitting panel, all coupled together and supported to form an enclosed chamber. The transmitting panel is capable of transmitting a majority of the radiant energy from the solar radiation spectrum so as to heat the enclosed chamber in the manner of a sauna. A door opening is provided at one end of the structure to permit entry to a user, while an embodiment of the invention shown in FIG. 8 of the patent discloses a semicircular transparent enclosure wherein a user could utilize the sauna while in a reclining position. However, this embodiment of the invention is not designed to be positioned over a pre-existing lounge chair or beach blanket, nor are adequate ventilation means provided to permit a user to adjust the temperature therein.

Accordingly, there exists a continuing need for new and improved solar heated saunas, wherein a user thereof can recline comfortably therein while also being provided with adjustable temperature control means, and in this respect, the present invention substantially fulfills this need.

SUMMARY OF THE INVENTION

In view of the foregoing disadvantages inherent in the known types of portable solar heated structures now present in the prior art, the present invention provides a improved solar heated sauna wherein the same can be positioned over existing lounge chairs or beach blankets and wherein a user thereof can adjust the temperature within. As such, the general purpose of the present invention, which will be described subsequently in greater detail, is to provide a new and improved solar heated sauna which has all the advantages of the prior art solar heated structures and none of the disadvantages.

To attain this, the present invention is directed to the construction of a semicircular section of transparent or smoke colored rigid plastic, with such rigid plastic also covering the remote ends thereof. The section of rigid plastic is positionable over a beach blanket or lounge chair so as to completely cover the user, and ventilation holes are provided at the topmost portions of the end panels. In the event that the heat is so intense as to require additional ventilation, portions of the transparent rigid plastic end panels may be opened to allow a greater flow of heated air to escape from the sauna. Holes on bottom edge portions of the sauna extend completely therethrough and are utilized both as handles and for the purpose of allowing fresh air to enter the enclosure to replace the heated air moving out of the ventilation holes. The various sections of rigid plastic may be bolted together to facilitate their disassembly and storage when not being utilized.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved solar heated sauna which has all the advantages of the prior art solar heated saunas and none of the disadvantages.

It is another object of the present invention to provide a new and improved solar heated sauna which may be easily and efficiently manufactured and marketed.

It is a further object of the present invention to provide a new and improved solar heated sauna which is of a durable and reliable construction.

An even further object of the present invention is to provide a new and improved solar heated sauna which is susceptible of a low cost of manufacture with regard to both materials and labor, and which accordingly is then susceptible of low prices of sale to the consuming public, thereby making such solar heated saunas economically available to the buying public.

Still yet another object of the present invention is to provide a new and improved solar heated sauna which provides in the apparatuses and methods of the prior art some of the advantages thereof, while simultaneously overcoming some of the disadvantages normally associated therewith.

Still another object of the present invention is to provide a new and improved solar heated sauna that provides for adjustable ventilation control to thus control the temperature and humidity therein.

Yet another object of the present invention is to provide a new and improved solar heated sauna which is utilizable in conjunction with a pre-existing lounge chair or beach blanket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWING

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
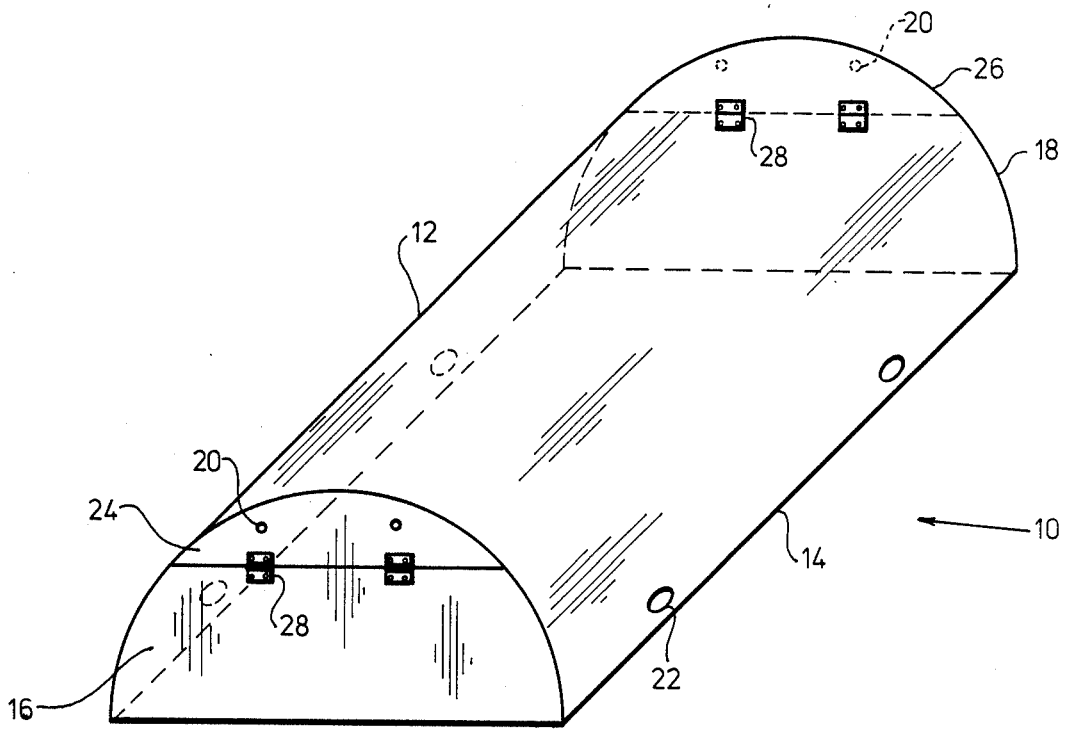
FIG. 1 is a perspective view of the solar heated sauna comprising the present invention.

With reference now to the FIG. 1 drawing, a new and improved solar heated sauna embodying the principles and concepts of the present invention and generally designated by the reference numeral 10 will be described.

More specifically it will be noted that the solar heated sauna 10 comprising the present invention essentially consists of a semicircular section of transparent, translucent or smoked rigid plastic 12 with such rigid plastic being open along a bottom section 14 and being closed at its respective ends by end panels 16, 18, also formed of the same rigid plastic. The section of rigid plastic 10 is of a sufficient length to overlie a beach blanket or lounge chair, and is also of a sufficient height to extend upwardly therefrom a sufficient distance so as to permit a sunbather to recline on the chair or blanket. Thin and lightweight rigid plastic should be utilized so as to allow a sunbather to easily remove the sauna 10 when required or alternatively, to position the same over his chair or his blanket.

To facilitate temperature and humidity control within the sauna 10, the respective ends 16, 18 are provided with through-extending apertures 20 with such apertures allowing a controlled amount of heated air to radiate outwardly from inside the sauna. Along bottom edge portions of the sauna 10, a plurality of elongated apertures 22 are provided, with these further apertures serving as handholds to facilitate the movement of the sauna, as well as air intakes through which fresh air may flow to replenish the air moving outwardly through the apertures 20.

Under conditions of intense heat and humidity, it can be appreciated that the apertures 20 may not remove intensely heated and humidified air at a rapid enough rate. As such, the end panels 16, 18 are each provided with respective fold down panels 24, 26. The panels 24, 26 essentially represent a portion of the respective end panels 16, 18 and are hingedly attached thereto by conventional hinges 28. Any form of connection or attachment means can be utilized to hold the panels 24, 26 in an upward unopened position, and all such conventional attachment means are within the intent and purview of the present invention.

With respect to the manner of usage of the present invention, the same should be apparent from the above description. Accordingly, no further description thereof will be provided. However, it should be noted that the sauna 10 could be constructed from a plurality of separable panels, each of which are connected together by some conventional means, such as through the use of threaded fasteners or the like, thereby to provide for the disassembly and storage of the unit when not being used. Further, it is to be understood that various accessories could be included within the sauna 10, to include thermometers, water spray devices for cooling the sunbather, and air movement means, such as a small fan or the like.

With respect to the above description then, it is to realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A solar heated structure comprising:

a. cover means serving to collect heat and humidity therein so as to provide a sauna-like atmosphere for a sunbather, said cover means being constructed from a substance selected from the group consisting of transparent rigid plastic, translucent rigid plastic, and smoke colored rigid plastic, said cover means having a semi-cylindrical shape with a bottom open portion positionable over said sunbather;

b. adjustable ventilation means for controlling a rate of air movement into and out of said cover means, said adjustable means including at least one through-extending aperture located near a topmost portion of said cover means, said adjustable ventialation means also including at least one further through-extending aperture located along a bottommost portion of said cover means, said further through-extending aperture also serving as a handhold to facilitate a movement of said cover means, said adjustable ventilation further including at least one openable panel on an end portion of said cover means, said panel being hingedly connected to said end portion.

* * * * *